US005984735A

United States Patent [19]

Daoud

[11] Patent Number: 5,984,735

[45] Date of Patent: Nov. 16, 1999

[54] MATERIAL DISPLACEMENT TYPE RETENTION MECHANISM FOR CONNECTOR TERMINALS

[75] Inventor: Bassel Hage Daoud, Parsippany, N.J.

[73] Assignee: Lucent Technologies Inc., Murry Hill, N.J.

[21] Appl. No.: 09/143,204

[22] Filed: Aug. 28, 1998

[51] Int. Cl.[6] ..... H01R 13/40

[52] U.S. Cl. ..... 439/733.1; 439/387

[58] Field of Search ..... 439/733.1, 387, 439/389, 396

[56] References Cited

U.S. PATENT DOCUMENTS

| | | | |
|---|---|---|---|
| 4,682,835 | 7/1987 | Aujla et al. | 439/395 |
| 5,226,840 | 7/1993 | Wojtamek | 439/733 |
| 5,277,621 | 1/1994 | Seto | 439/493 |
| 5,286,218 | 2/1994 | Sakurai et al. | 439/444 |
| 5,362,256 | 11/1994 | Hashiguchi | 439/660 |
| 5,453,028 | 9/1995 | Grambley et al. | 439/441 |
| 5,489,221 | 2/1996 | Fujiura et al. | 439/733.1 |
| 5,549,480 | 8/1996 | Cheng | 439/79 |
| 5,567,185 | 10/1996 | Henderson et al. | 439/733.1 |
| 5,609,502 | 3/1997 | Thumma | 439/747 |
| 5,692,928 | 12/1997 | Nelson et al. | 439/733 |
| 5,888,091 | 3/1999 | McQuilkin Murr | 439/427 |

*Primary Examiner*—Paula Bradley
*Assistant Examiner*—Truc Nguyen

[57] ABSTRACT

The invention discloses an insulation displacement connector terminal having a material displacement type retention mechanism which securely retains the terminal within its cooperative housing. The terminal has at least one plow-shaped notch having a pointed tip on the body of the terminal. While the terminal is being inserted into its housing, the pointed tip pierces and peels the housing material, creating a lip, which is displaced into the notch. Upon full insertion of the terminal within its housing, the lip fills the notch, thereby securely retaining the terminal within the housing.

5 Claims, 5 Drawing Sheets

MATERIAL DISPLACEMENT TYPE RETENTION MECHANISM FOR CONNECTOR TERMINALS

CROSS REFERENCE TO RELATED APPLICATION

This application is related to U.S. patent application Ser. No. 09/143,203 and also identified by Docket Number Daoud 123 and is assigned to the same assignee as the present invention.

FIELD OF THE INVENTION

The invention relates to an insulation displacement connector terminal which facilitates the installation of the terminal within a cooperative housing and securely retains it in the housing.

BACKGROUND OF THE INVENTION

Insulation Displacement Connector (IDC) terminals are widely used in different types of application for connecting wires; particularly in the telecommunication industry. An IDC terminal eliminates the need to strip the insulation from a wire prior to making connection by providing a pair of tapered beams which pierce the insulation upon seating the wire between the beams of the IDC terminal. Hence, connection of an insulated wire can be accomplished in one step, which is both efficient and cost-effective.

There are two general types of IDC terminals, double-ended or single-ended. A double-ended IDC terminal has a pair of beams on each end; whereas a single-ended IDC terminal has a pair of beams on one end and a post on the opposite end for wire wrapped connections.

IDC terminals are fitted in channels or slots within a dielectric housing, such as plastic, to provide safe and secure is connections between wires. For proper function of an IDC terminal, it is essential that IDC terminals are safely secured within such housing. Good retention of IDC terminals in the housing is necessary to sustain the force exerted upon the IDC terminals when wires are seated and snubbed between beams of the IDC terminals. Otherwise, IDC terminals may be displaced from the housing when compressive force of the wires are exerted upon the terminals without properly piercing the insulation and connecting the wires, causing performance failure.

A prior art single-ended IDC terminal is held in entry slot of a cooperative housing with a pair of small barbs protruding on each side of the IDC terminal. During the insertion process of such an IDC terminal into its housing, the plastic housing where such barbs pass through is compressed due to the inflexibility of the barbs. Deformation of the plastic housing is permanent and may be excessive, resulting in a larger opening in the slot. The deformation of the plastic housing provides an avenue for the IDC terminal to move backward against the direction of insertion when force is exerted on the IDC terminal during the wire seating process. The disadvantage of such a prior art IDC terminal cannot be overcome by having larger sized barbs because deformation of the housing increased proportionally to the increase in the barb size, which would not improve the retention of the IDC terminal within the housing. To properly secure such prior art IDC terminal in its housing, a cooperative base is necessary to prevent the displacement of the IDC terminal from its housing.

Therefore, there is a need for an IDC terminal that can be inserted into a dielectric housing that can be securely fitted within such a housing to sustain the force exerted by the seating of wires without a cooperative unit and be inserted into its housing efficiently and in a cost-effective manner.

SUMMARY OF THE INVENTION

The invention provides a device that securely fits, in an efficient and cost-effective manner, in its cooperative housing to ensure proper inter-connection between wires.

The invention provides an insulation displacement connector (IDC) terminal that is securely retained within a cooperative housing by merely inserting the terminal into an entry slot of the housing, and which can sustain compressive force exerted on the terminal during seating of wires on the terminal without its displacement.

The IDC terminal of the present invention has a material displacement type retention system which comprises a pair of plow-shaped notches having pointed tips. The notches advantageously extend from opposite sides of the terminal and the tips extend beyond the edges of the terminal in the direction of entry into an entry slot of the cooperative housing. Thus, when the IDC terminal is inserted into the entry slot of the housing, the pair of pointed tips pierce into the housing, displacing the material of the housing. Upon full insertion of the terminal, the pointed tips cause the displaced material to fill the pair of notches, thereby preventing the terminal from moving against the direction of insertion. Hence, a separate cooperative base is not necessary to prevent displacement of the terminal from its housing during the wire seating process.

DETAILED DESCRIPTION OF THE PREFERRED EMBODIMENTS

Figure 1:
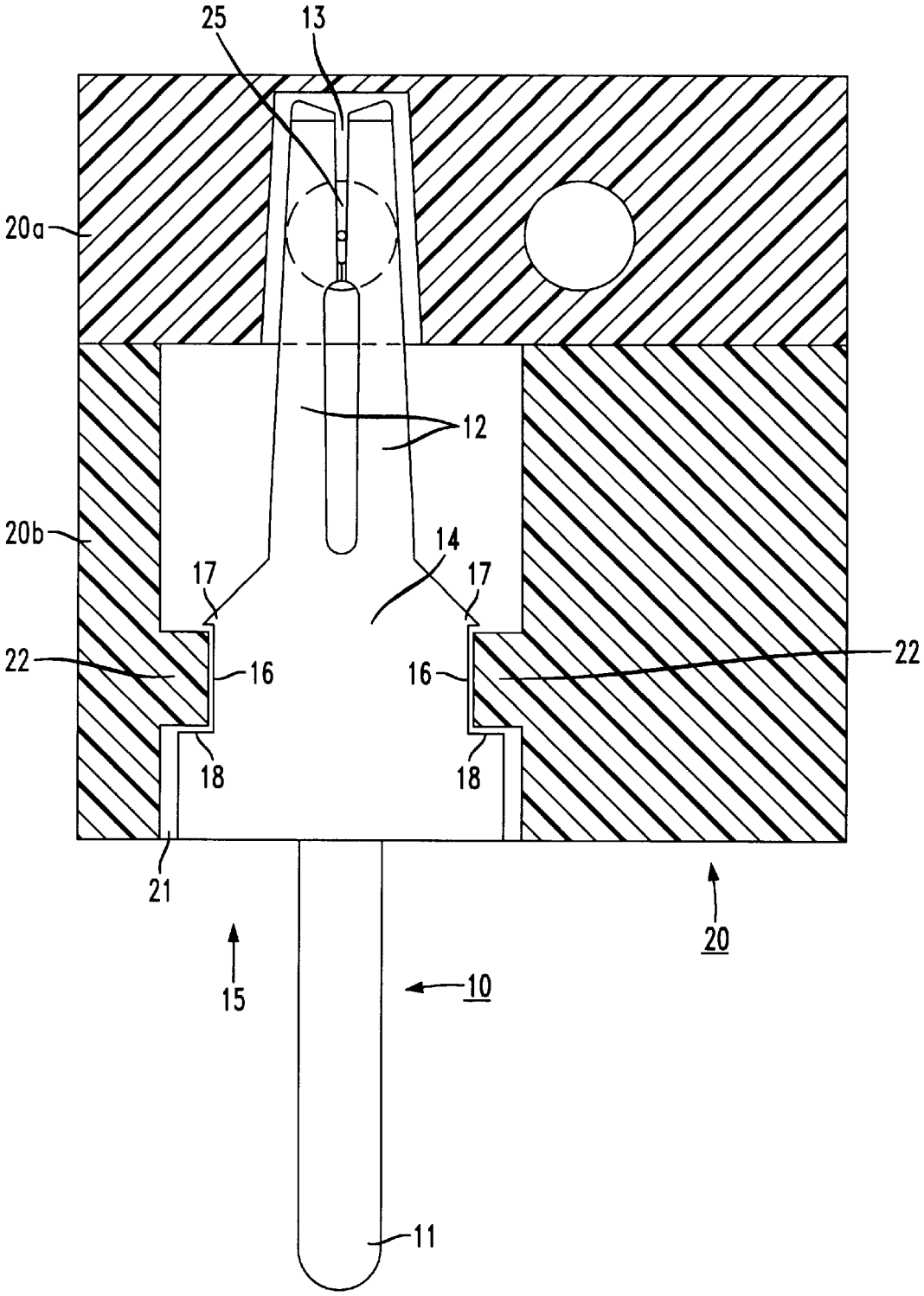
FIG. 1 PRIOR ART
FIG. 1 is a cross-sectional view of a cooperative housing with a prior art insulation displacement connector terminal utilizing side barbs to secure it within the housing.

With reference to the drawings, wherein the same reference number indicates the same element throughout, there is shown in FIG. 1 a cross-sectional view of a cooperative housing 20 with a prior art insulation displacement connector (IDC) terminal 10. Prior art terminal 10 is made of an electrically conducting material, whereas housing 20 is made of a dielectric material.

As shown in FIG. 1, cooperative housing 20 comprises a top portion 20*a* and a bottom portion 20*b*. Top portion 20*a* provides coverage and isolation of wire 25 inserted into IDC terminal 10 and bottom portion 20*b* provides an entry slot 21 for terminal 10.

Prior art IDC terminal 10 is a single-ended type having a post 11 for wire wrap connection on one end and a pair of cantilever beams 12, defining an elongated slot 13 therebetween, for snubbing and seating of wires, on the opposite end. Body 14 of prior art terminal 10 has a pair of side notches 16 for mating with a pair of tongues 22 extending into entry slot 21 of housing 20 for securing terminal 10 within housing 20. The pair of tongues 22 define a narrower portion of entry slot 21. The pair of side notches 16 are defined on one side by a pair of side barbs 17 and the other side by a wider portion 18 of body 14.

During the insertion process of the prior art terminal 10 into entry slot 21 of housing 20 in the direction of directional arrow 15, the pair of side barbs 17 is forced through the narrower portion of entry slot 21 until notches 16 engage tongues 22 and the wider portion 18 of body 14 makes contact with tongues 22. While prior art terminal 10 is inserted into its cooperative housing 20, side barbs 17 caused deformation of the wall of tongue 22 and widen the entry slot 21 between tongues 22. Thereby, providing minimal retention of prior art terminal 10 within housing 20, especially when force is applied to snub or seat a wire 25 onto terminal 10.

Figure 2:
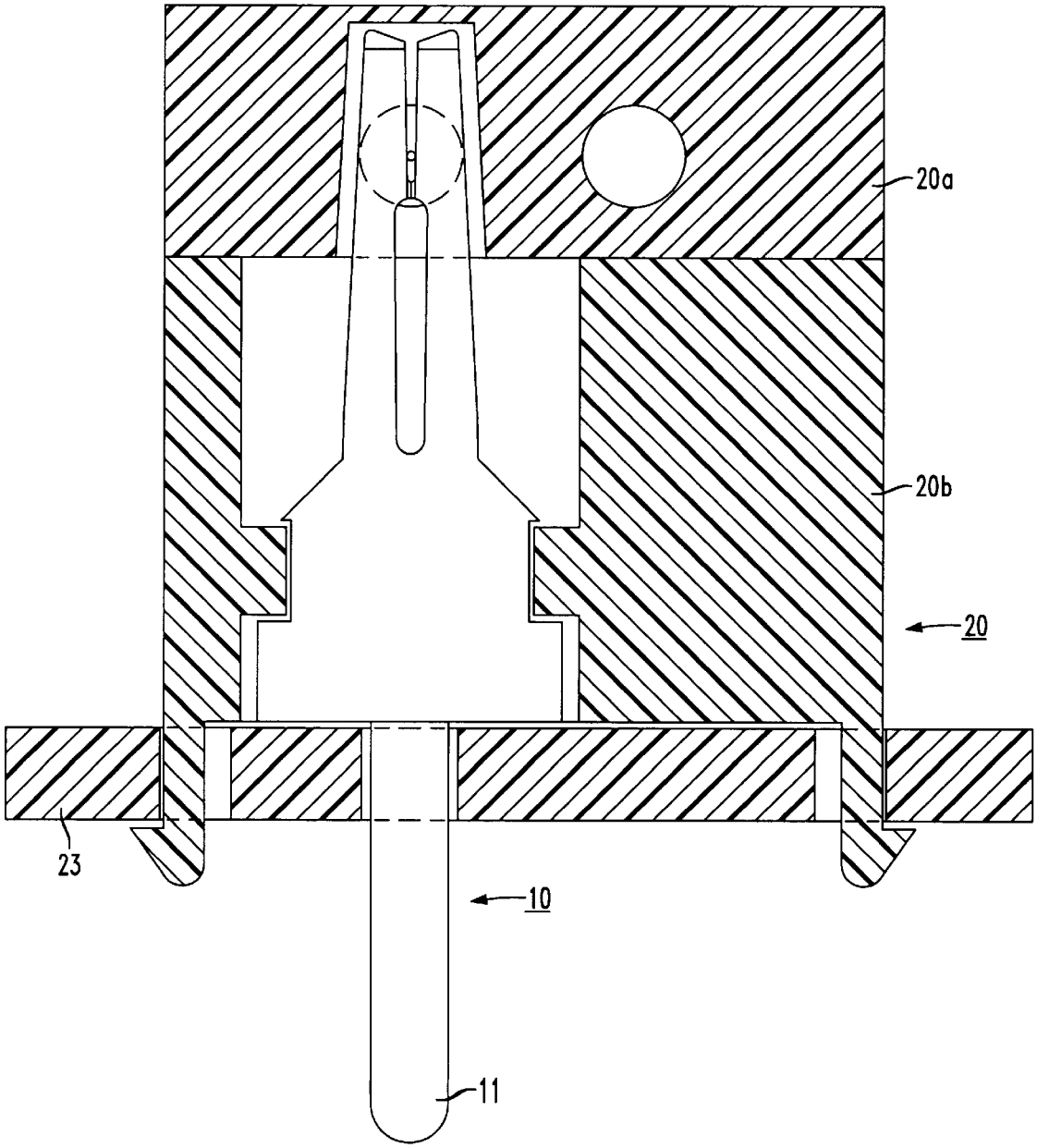
FIG. 2 PRIOR ART
FIG. 2 is a cross-sectional view of a cooperative housing with a prior art insulation displacement connector terminal utilizing side barbs, illustrating the necessity of a cooperative base.

To provide better retention of prior art IDC terminal 10 within housing 20, FIG. 2 shows the necessity of a cooperative base 23 adapted for use with housing 20 to prevent the displacement of terminal 10 from housing 20 during the snubbing process. The use of a cooperative base 23 increases the cost, time and effort in the assembly of the combined unit.

Figure 3:
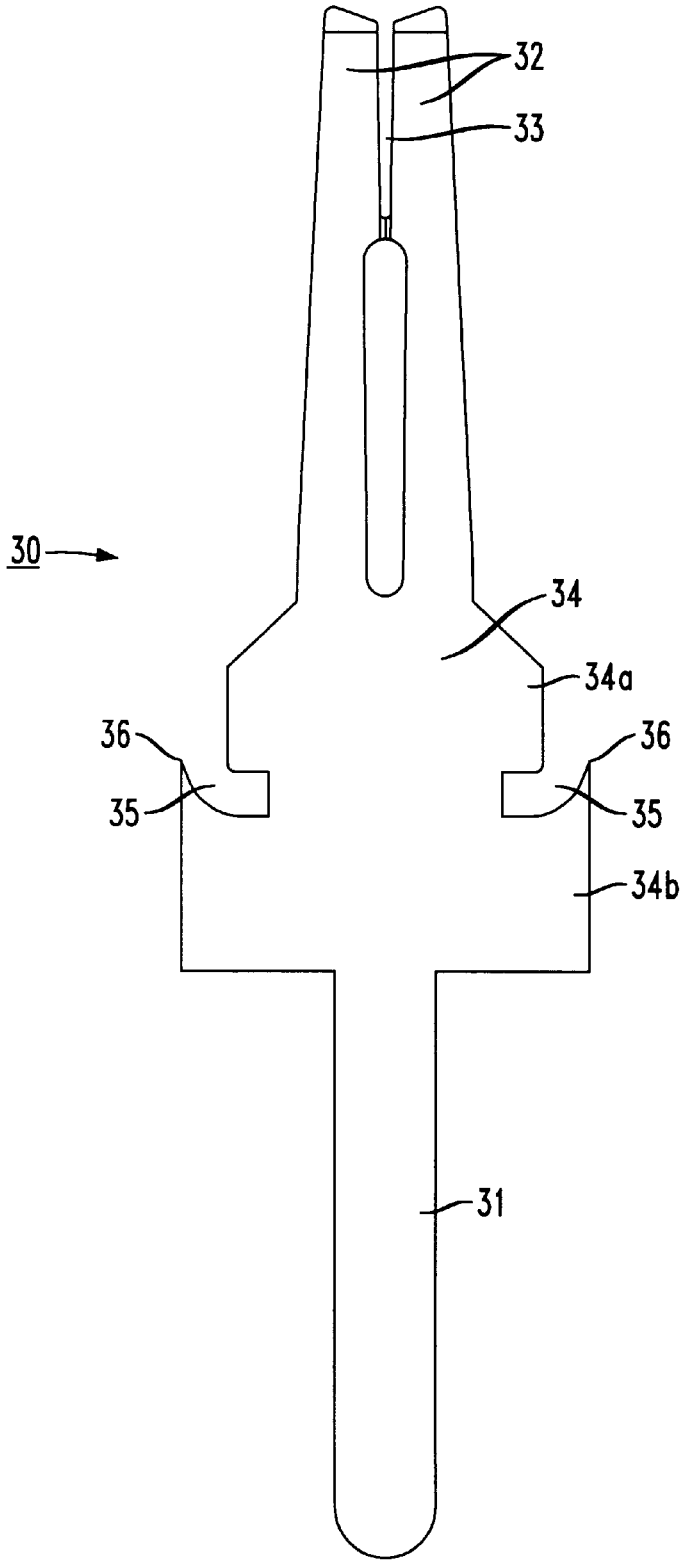
FIG. 3 is a front elevational view of the present invention illustrating the plow-shaped notches of the terminal.

The present invention, insulation displacement connector (IDC) terminal 30, as shown in FIG. 3, having a post 31 for wire wrap connection on one end and a pair of cantilever beams 32, defining an elongated slot 33 therebetween for snubbing and seating of wires, on the opposite end. Terminal 30 is made of an electrically conducting material. The body 34 of terminal 30 has a narrower portion 34*a* and a wider portion 34*b*. At the wider body portion 34*b* is a pair of plow-shaped notches or opening 35 having pointed tips 36 on opposite sides of terminal 30, with pointed tips 36 extending beyond narrower portion 34*a* of body 34.

Figure 4B:
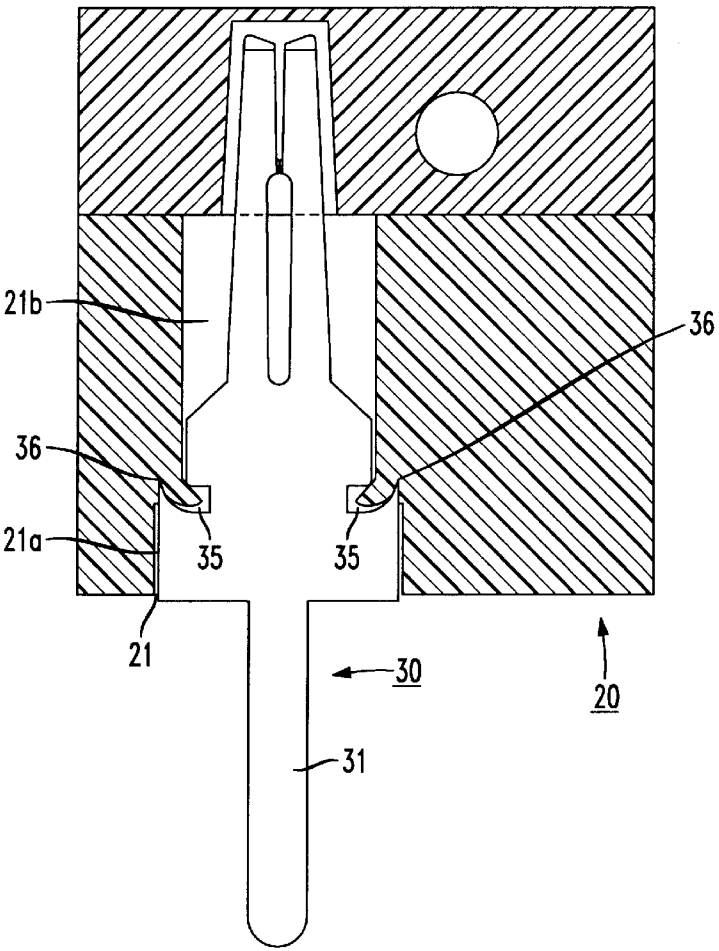
FIG. 4, comprises of FIG. 4A, 4B and 4C, illustrate the insertion of the terminal and the displacement of the housing material to achieve retention of the terminal.
Figure 4A:
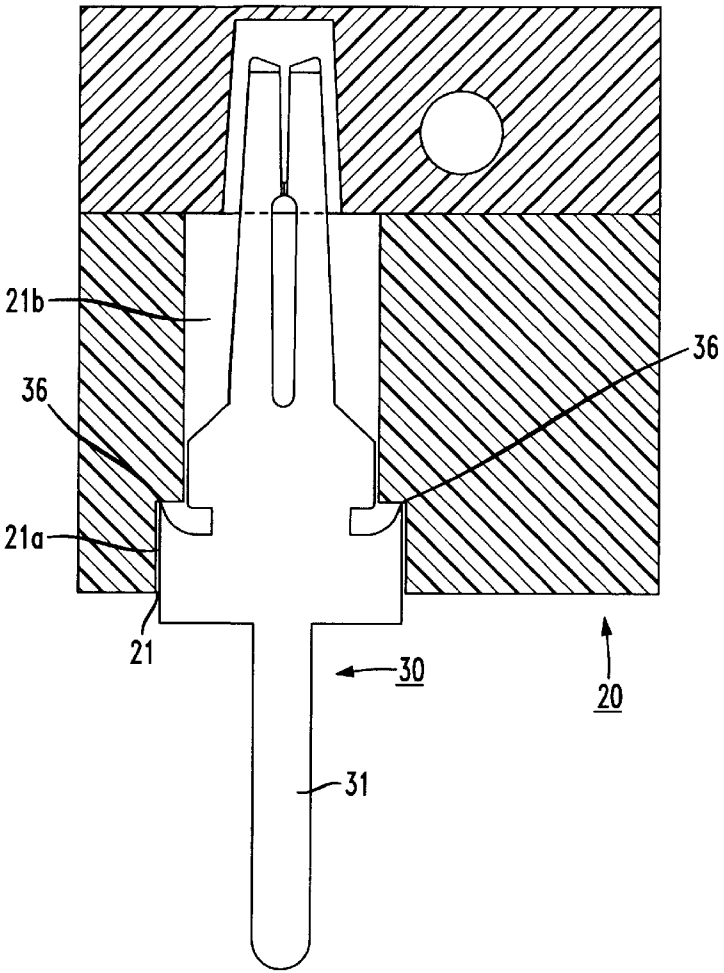
Figure 4C:
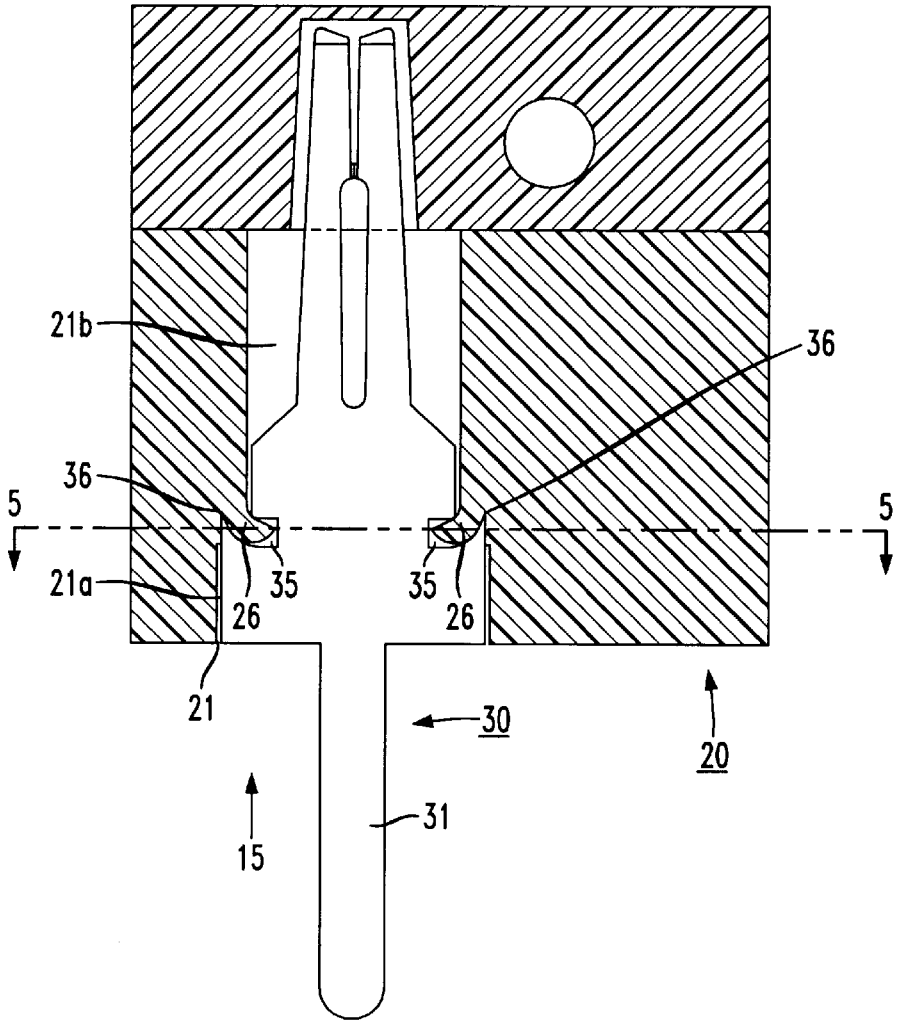

FIGS. 4A, 4B and 4C illustrate the insertion of terminal 30 into housing 20. Entry slot 21 of housing 20 includes a wider portion 21*a* and a narrower portion 21*b*, which are dimensioned to mate with wider body portion 34*b* and narrower body portion 34*a*, respectively, as shown in FIG. 4A.

As shown in FIG. 4B, while terminal 30 is being inserted into housing 20, pointed tips 36 pierce into the narrower entry slot portion 21*b* of housing 20, and peel the housing material, creating a pair of lips 26.

Full insertion of terminal 30 is accomplished when post 31 of terminal 30 is flushed against the surface of housing 20, as shown in FIG. 4*c*. Upon full insertion of terminal 30 into housing 20, the displaced housing material, i.e. the pair of lips 26, fill notches 35 such that terminal 30 is prevented from moving against the direction of insertion, shown by directional arrow 15. Each notch 35 is at a predetermined size slightly larger than the size of each lip 26 with terminal 30 at full insertion, such that lips 26 substantially fill notches 35 to limit the movement of terminal 30 within housing 20 and to prevent over-insertion of terminal 30 into housing 20.

Figure 5:
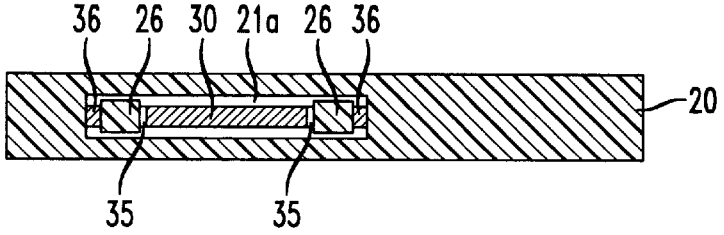
FIG. 5 is a cross-sectional view of a fully inserted terminal within its cooperative housing taken along line 5—5 of FIG. 4C.

As shown in FIG. 4C and 5, the pair of lips 26 securely hold terminal 30 in housing 20 and prevent terminal 30 from displacement when wire 25 is being snubbed and seated on terminal 30. The retention of terminal 30 by the displaced material, the pair of lips 26, eliminates the need of a cooperative base 23. The assembly of inserting terminal 30 into housing 20 to achieve good retention is accomplished in an efficient and cost-effective manner.

An alternative method of inserting terminal 30 into housing 20 by pressure or force is the ultrasonic insertion process, known to one skilled in the art. When terminal 30 is ultrasonically inserted, the electrically conductive terminal 30 heats up and soften or melts housing 20 where pointed tips 36 make contact. Upon full insertion of terminal 30 into housing 20, the peeled lips 26 created by pointed tips 36 is softened and flow into and fill notches 35. After the ultrasonic insertion process, the displaced housing material, i.e. lips 26, solidify around the plow-shaped notches 35, providing enhanced retention of terminal 30 within housing 20 to sustain compressive force exerted upon terminal 30 during the wire seating process.

Although certain features of the invention have been illustrated and described herein, other better modifications and changes will occur to those skilled in the art. It is, therefore, to be understood that the appended claims are intended to cover all such modification and changes that fall within the spirit of the invention.

What I claim is:

1. An insulation displacement connector terminal for insertion and retention within a cooperative housing having an entry slot, comprising:

(a) a body; and (b) at least one plow-shaped notch on said body, each of said plow-shaped notch having a pointed tip for piercing and peeling said housing when said terminal is inserted into said slot, creating a lip on said housing during insertion, and upon full insertion of said terminal within said housing said lip fills said notch, thereby retaining said terminal within said housing.

2. The insulation displacement connector terminal according to claim 1 wherein said body is made of an electrically conducting material.

3. The insulation displacement connector terminal according to claim 1 wherein said body having a narrower and a wider portion, said plow-shaped notch at said wider portion of said body, with said pointed tip of said plow-shaped notch extends beyond said narrower portion of said body.

4. The insulation displacement connector terminal according to claim 1 wherein said plow-shaped notch is at a predetermined size which limits the movement of said terminal within said housing and prevents over-insertion of said terminal into said housing.

5. An insulation displacement connector terminal for insertion and retention within a cooperative housing having an entry slot, said terminal provides electrical contact between first and second conductors, comprising:

(a) a body having first and second ends, said first end having a pair of cantilever beams defining an elongated slot therebetween for seating and snubbing said first conductor and said second end having a post for wire wrapping said second conductor;

(b) at least one plow-shaped notch on said body, each of said plow-shaped notch having a pointed tip for piercing said housing when said terminal is inserted into said slot, creating a lip on said housing, during insertion, and upon full insertion of said terminal within said housing said lip fills said notch, thereby retaining said terminal within said housing.

* * * * *